US007413764B2

(12) United States Patent
Mead et al.

(10) Patent No.: US 7,413,764 B2
(45) Date of Patent: Aug. 19, 2008

(54) PROCESS FOR REPAIRING COATINGS HAVING A CRITICAL THICKNESS

(75) Inventors: William T. Mead, Long Beach, CA (US); Jorge A. Millan, Lawndale, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 991 days.

(21) Appl. No.: 10/867,356

(22) Filed: Jun. 14, 2004

(65) Prior Publication Data

US 2005/0276915 A1 Dec. 15, 2005

(51) Int. Cl.
*B05D 3/00* (2006.01)

(52) U.S. Cl. ..... 427/140; 428/63; 156/94; 114/229

(58) Field of Classification Search ..... 427/140, 427/142; 156/98, 94; 428/63; 52/741.4, 52/741.5, 514, 395; 114/229
See application file for complete search history.

(56) References Cited

U.S. PATENT DOCUMENTS 5,053,251 A * 10/1991 Hara et al. ..... 427/142
5,143,275 A * 9/1992 Hara et al. ..... 228/119

* cited by examiner

*Primary Examiner*—Michael Cleveland
*Assistant Examiner*—Briget P Ngampa
(74) *Attorney, Agent, or Firm*—Louis L. Dachs

(57) ABSTRACT

The invention is a process for repairing a coating having a precise thickness damaged in a specific area. In detail, the process includes the steps of: 1) removing the damaged coating from the specific area; 2) placing a scrim material having a thickness equal to the required thickness of the coating in the specific; and 3) filling the specific area with coating material to the thickness of the scrim material.

6 Claims, 3 Drawing Sheets

PROCESS FOR REPAIRING COATINGS HAVING A CRITICAL THICKNESS

BACKGROUND OF THE INVENTION

1. Field of the Invention

The invention relates to the field of coating applicator processes and, in particular, to a coating process for repairing coating requiring a very precise thickness.

2. Description of Related Art

In most instances, the thickness of a painted coating is not critical; the principle issue is complete covering of the surface. Thus repair is a simple matter; one need only clean up the repair and re-coat with a brush or roller. However, if the coating thickness is critical, then such repairs become difficult, especially in the field. For example, Radar Absorbing Material (RAM) coatings are held to a precise thickness in order to insure that radar signals of a particular frequency of interest are absorbed. These coating are applied by spray guns in order to insure that the proper thickness is applied. Often, several passes are made, requiring the testing of absorption properties between each pass.

Thus it is obvious that repair of such RAM coatings in the field is a difficult process. While portable handheld RAM coating testing apparatus is available, spray-coating equipment may not be readily available. Proper thickness has been obtained using rollers or paintbrushes, but is a time consuming process involving a lot of trial and error. This is because the required ratio of solvent to resin is significantly different when using a roller in stead of a spraying machine.

Thus, it is a primary object of the invention to provide a process for repairing coatings having a precise thickness.

It is another primary object of the invention to provide a process for repairing coatings having a precise thickness using scapulas and rollers.

It is a further object of the invention to provide a process for repairing RAM coatings having a precise thickness that does not effect the radar absorbing properties of the coating.

SUMMARY OF THE INVENTION

The invention is a process for repairing a coating having a precise thickness damaged in a specific area. In detail, the process includes the steps 1. Removing the damaged coating from the specific area. Preferably, this step includes removing the area about the damaged area such that an opening having defined area with a specific size and specific shape is formed. Furthermore, this step includes tapering the edge of the opening.
2. Placing a scrim material having a thickness equal to the required thickness of the coating. Preferably, this step includes the step of tapering about its periphery to match that of the tapered opening. The scrim can be made of a dielectric material or a conductive material.
3. Filling the specific area with coating material to the thickness of the scrim material.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
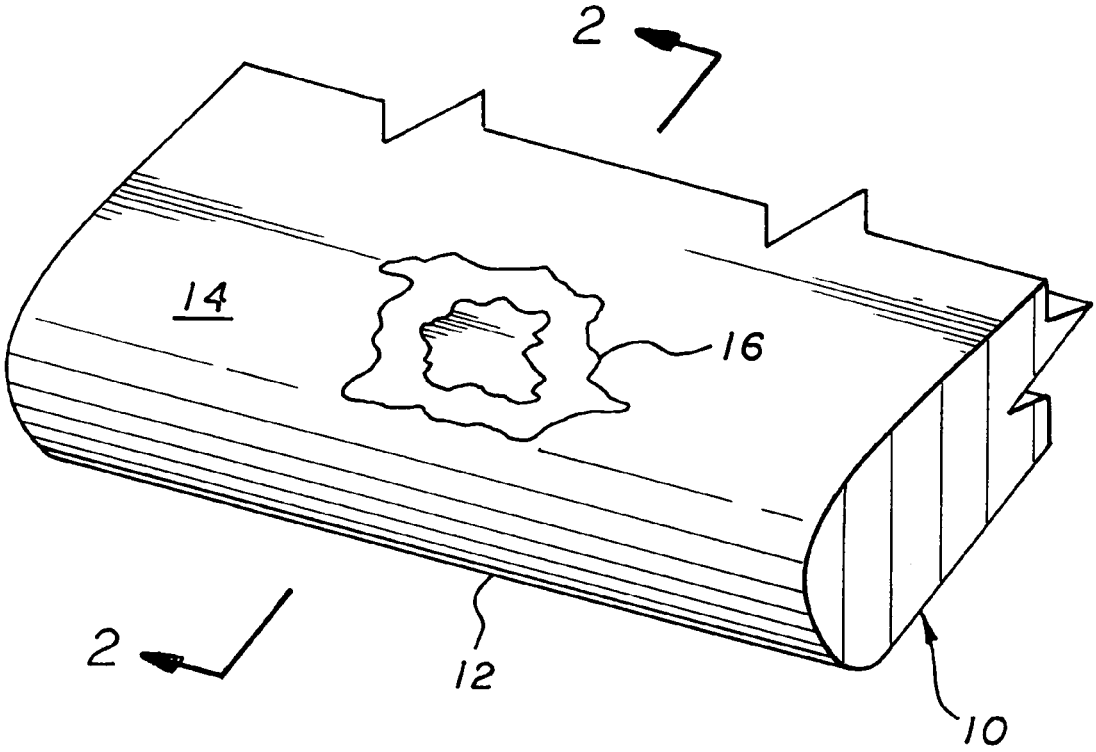
FIG. 1 is a partial perspective view of the wing of an aircraft having a damaged area.
Figure 2:
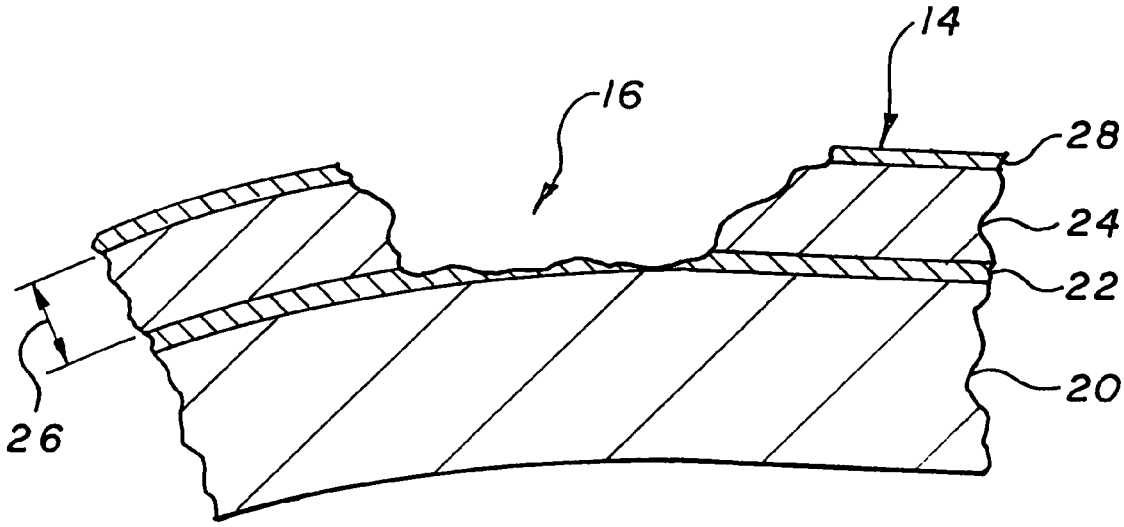
FIG. 2 is a partial cross-sectional view of the wing shown in FIG. 1, detailing the damaged area.

Illustrated in FIGS. 1 and 2, is a partial perspective view of an aircraft wing 10 with a leading edge 12 covered with a multi-layer coating 14. The coating includes a damaged area 16 having an irregular shape. Referring to FIG. 2, the coating 14, which covers a structure 20 includes a primer coating 22, RAM coating 24 having a required thickness 26 and a top coat 28. The thickness 26 of the RAM coating is critical and any repair must insure that this thickness be maintained during repair, less the radar signature of the aircraft be compromised. Such RAM coatings are known to contain large amounts of metal particles (iron) or graphite particles. If the aircraft were located in a facility that contained spray painting equipment, the repair would be accomplished by masking off the area surrounding damaged area and spraying the individual layers. However, in remote locations spray painting equipment may not be available.

Figure 3:
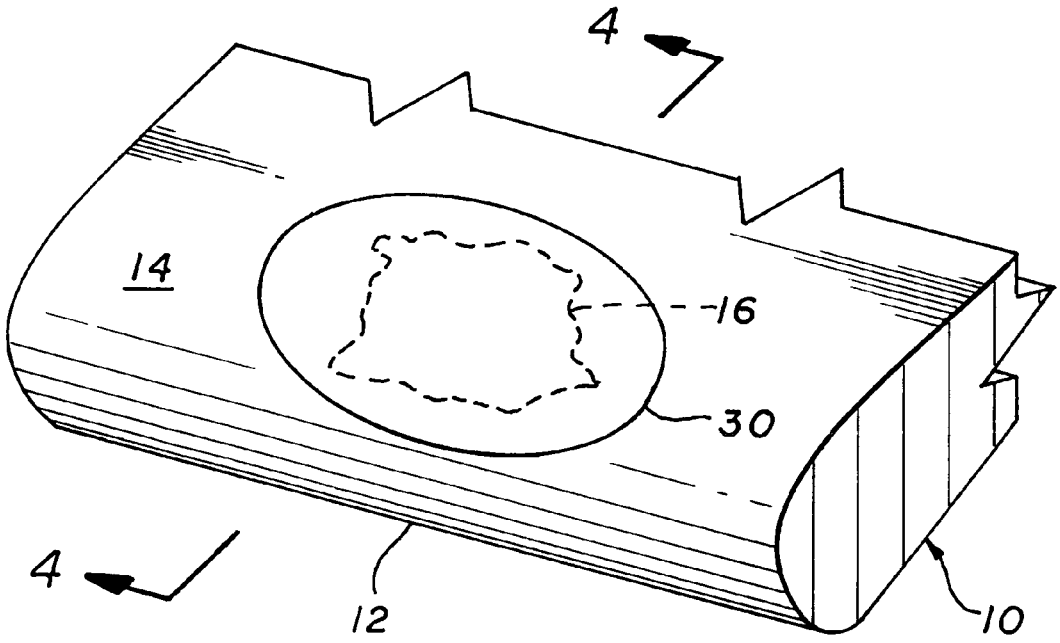
FIG. 3 is a partial view of the wing shown in FIG. 1 showing the damaged area after clean up and prior to re-coating.
Figure 4:
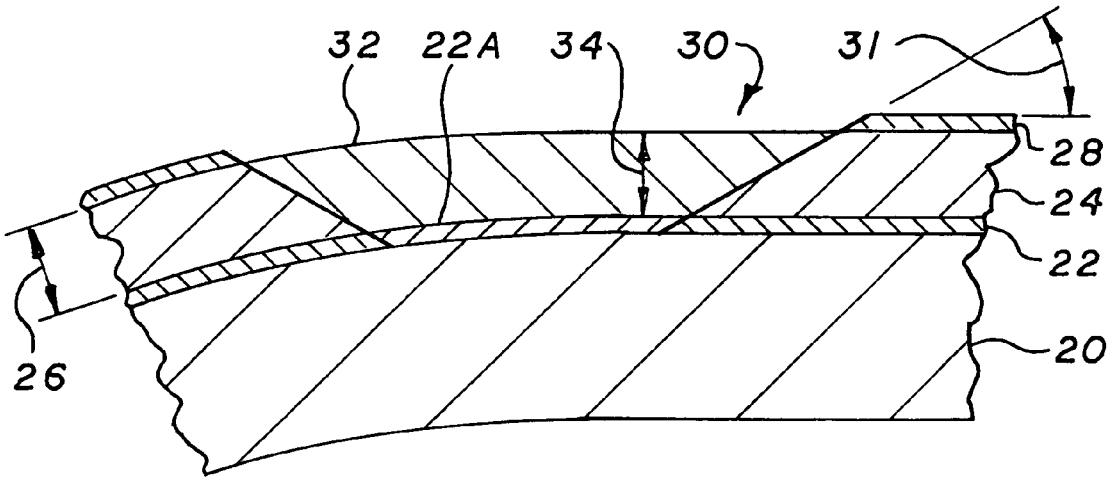
FIG. 4 is a cross-sectional view of FIG. 3 taken along the line 4-4 showing the insertion of a scrim clothe into the area under repair.
Figure 5:
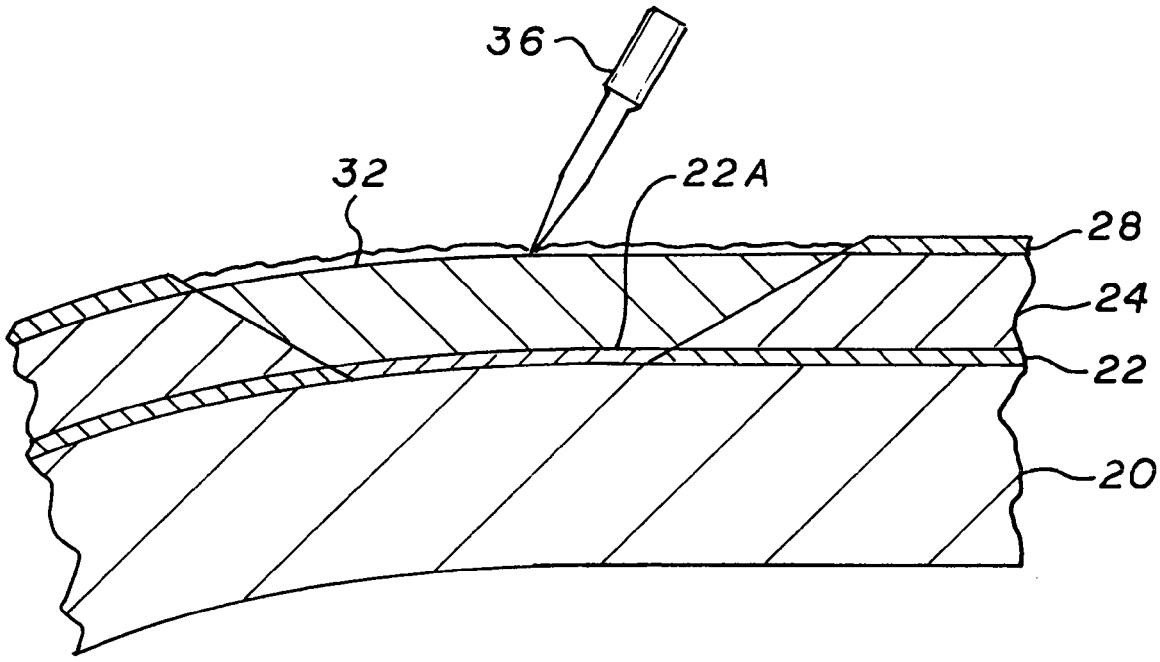
FIG. 5 is view similar to FIG. 4 showing the filling of the scrim clothe with resin by means of a spatula.

When suitable spraying equipment is unavailable the subject process can be used. Referring to FIGS. 3 and 4, if the damaged area is very irregular, the first step is to remove enough of the coating about the damage area to produce a simple shape such as a circle 30 as shown tapered at an angle 31 at its periphery. Preferably the taper angle 31 is between x degrees and y degrees. Other shapes may include rectangular or square shapes. A primer coating 22A is applied with a brush or foam applicator (not shown).

This coating 22A is allowed to dry and thereafter a scrim cloth or screen 32 having a thickness 34 equal to the thickness 26 of the coating 24 and a peripheral taper angle of 34 degrees equal to the taper angle 31 and sized to fill the gap in the RAM coating 24. It has the same shape and area of the rectangle 30 having. The scrim can be made of a dielectric material, such as NYLON®. For example, a screen like material having a weave providing 0.062-inch openings. If a conductive scrim is required, the NYLON® scrim material can be coated with a conductive material such as Aluminum. Ideally, the thickness should be sufficient such that a single layer of scrim is used. However, multi-layers can be used. The important feature is that it must provide sufficient support for the RAM so that it can be loaded to the thickness 26. Suitable conductive and non-conductive scrim material can be obtained from Hexcel Corporation, Dublin, Calif. It should also be noted that the material can be provided in almost any thickness desired.

Figure 6:
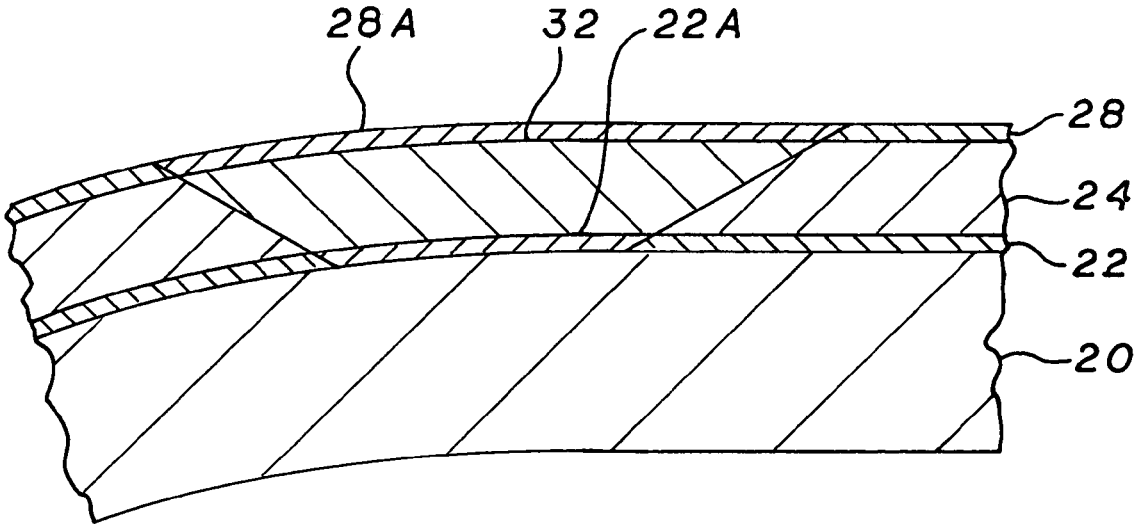
FIG. 6 is a view similar to FIG. 4 showing the filling of the scrim clothe with brush type applicator.

The RAM material typical comes in a loaded resin/catalyst mixture that is very dense, having a consistency of putty. Thus application by means of a squeeze is a preferred method. Regardless of the method used, the scrim is filled completely to the top; thus insuring that the desired radar absorbing properties are obtained. After the RAM coating has cured, the top coating 26A can be added by use of a roller, providing the completely repaired coating shown in FIG. 6.

While the invention has been described with reference to a particular embodiment, it should be understood that the embodiment is merely illustrative, as there are numerous variations and modifications, which may be made by those skilled in the art. Thus, the invention is to be construed as being limited only by the spirit and scope of the appended claims.

INDUSTRIAL APPLICABILITY

The invention has applicability to coating industry.

The invention claimed is:

1. A process for repairing a coating having a precise thickness damaged in a specific area, the process comprising the steps of:

removing the damaged coating from the specific area;

placing a scrim material having a thickness equal to the required thickness of the coating in the specific area;

filling the specific area with coating material to the thickness of the scrim material.

2. The process as set forth in claim 1 wherein the step of removing the damaged coating from the specific area involves the step of removing area about the damaged area such that an opening having defined area having a specific size and specific shape is formed.

3. The process as set forth in claim 2 wherein the step of removing area about the damaged area such that an opening having defined area having a specific size and specific shape is formed includes the step of tapering the edge of the opening.

4. The process as set forth in claim 3 wherein the scrim material is tapered about its periphery to match that of the tapered opening.

5. The process as set forth in claim 1, or 2, or 3, or 4, wherein the scrim is made of a dielectric material.

6. The process as set forth in claim 1, or 2, or 3, or 4, wherein the scrim is made of a conductive material.

* * * * *